US006277157B1

(12) United States Patent
Georges et al.

(10) Patent No.: US 6,277,157 B1
(45) Date of Patent: Aug. 21, 2001

(54) IMAGE CONTAINING ELECTRICAL COMPONENT AND AN IMAGED WALL PLATE USED THEREWITH

(76) Inventors: Chris Georges, 35 Orange St. Apt. 5C, Brooklyn, NY (US) 11201; Thomas Georges, 4211 S. Haven Dr., Mason, OH (US) 45040

( * ) Notice: Subject to any disclaimer, the term of this patent is extended or adjusted under 35 U.S.C. 154(b) by 0 days.

(21) Appl. No.: 09/404,774

(22) Filed: Sep. 24, 1999

(51) Int. Cl.[7] ..... D06P 5/00
(52) U.S. Cl. ..... 8/471
(58) Field of Search ..... 8/471; D8/351

(56) References Cited

U.S. PATENT DOCUMENTS

| | | | |
|---|---|---|---|
| D. 230,700 | | 3/1974 | Rochford . |
| D. 243,918 | | 4/1977 | Creamer . |
| 1,280,655 | | 10/1918 | Briggs . |
| 1,660,346 | | 2/1928 | Neal . |
| 2,043,865 | | 6/1936 | Place . |
| 4,354,851 | | 10/1982 | Hix et al. . |
| 4,355,198 | | 10/1982 | Gartland, Jr. . |
| 4,406,662 | | 9/1983 | Beran et al. . |
| 5,031,525 | | 7/1991 | Kent et al. . |
| 5,142,722 | | 9/1992 | Kolb . |
| 5,296,081 | | 3/1994 | Morin et al. . |
| 5,824,116 | * | 10/1998 | Zutler . |

* cited by examiner

*Primary Examiner*—Margaret Einsmann
(74) *Attorney, Agent, or Firm*—William J. Sapone

(57) ABSTRACT

An electrical component and a wall plate have portions of a unitary image thereon such that when assembled, the unitary image is perceived. A thermally conductive collapsible sponge fills the contoured surface features of the electrical component during image transfer such that a high quality image transfer is attained.

12 Claims, 6 Drawing Sheets

IMAGE CONTAINING ELECTRICAL COMPONENT AND AN IMAGED WALL PLATE USED THEREWITH

TECHNICAL FIELD

This invention relates to the manufacture of an electrical component for mounting with a wall plate, the electrical component containing a first portion of a unitary image that matches a second portion of the unitary image carried by the wall plate.

BACKGROUND

Decorative wall plates used with various electric components such as switches, outlets, etc. are well known. For example, U.S. Pat. No. DES 243,918 shows a decorative wall plate for use with such switches and outlets.

Various technologies have been used to provide an image on a decorative wall plate. For example, the image can be painted onto the plate directly, or preferably, an image can be provided by a transfer printing process.

In U.S. Pat. No. 4,354,851 a method for making a decorated, water-resistant rigid panel is described where a flat precoated hard board panel receives a heat transferred image from a transfer sheet containing a sublimation ink decoration.

In U.S. Pat. No. 5,142,722, transfer printing of an image to a flat wooden substrate is described. In U.S. Pat. No. 5,824,116, an image is transferred simultaneously to a switch plate and its associated screws which are located in their mounting holes, the combination of screws and the plate providing an essentially flat transfer surface.

In each of these cases, a substantially flat substrate receives a transfer of an image by ink sublimation. The desire for continuous imaging over a switch plate has not carried over to the contained electrical component because it is considered impractical to transfer an image to an item with a complex surface such as a switch toggle, or electrical outlet receptacle. Such electrical components comprise from 10 to 70% of the surface area of the wall plate. As such, they detract significantly from the appearance presented when an imaged decorative wall plate is used. Other than color coordinator, the electrical component itself breaks up the continuous image.

SUMMARY OF THE SWITCH

It is an object of the present invention to provide a method for imaging electrical components and wall plates to provide a coordinated unitary image upon assembly.

It is a further object to provide an electrical component and a wall plate, each containing matching portions of a unitary image such that after assembly, the entire unitary image is perceived.

These and other objects of the present invention are achieved by a method comprising providing at least one electrical component and a wall plate having an opening for receiving the electrical component, providing an image in a digital form, sizing the image to have an outer dimension corresponding to the outer dimension of the wall plate, placing the component in the wall plate opening to produce an assembly, applying a heat transfer sheet containing the sized image on the assembly, and transferring the image by contacting the transfer sheet with collapsible thermally conductive pressing means that adapt to the contours of the assembly surfaces.

In another embodiment, a first portion of the image corresponding to the opening in the plate which receives the electrical component is selected and used to produce a first transfer sheet, and the unselected portion of the image forms a second image portion that is used to produce a second transfer sheet, such that each item can be separately imaged with its related portion. At least the electrical component utilizes the collapsible thermally conductive pressing means.

Preferably, the collapsible pressing means has a raised area that first contacts the transfer sheet, to ease adaption of the pressing means to the contours of the electrical component such that a high quality image is provided over the complex surface geometry typical of such components.

DETAILED DESCRIPTION OF THE INVENTION

Figure 1:
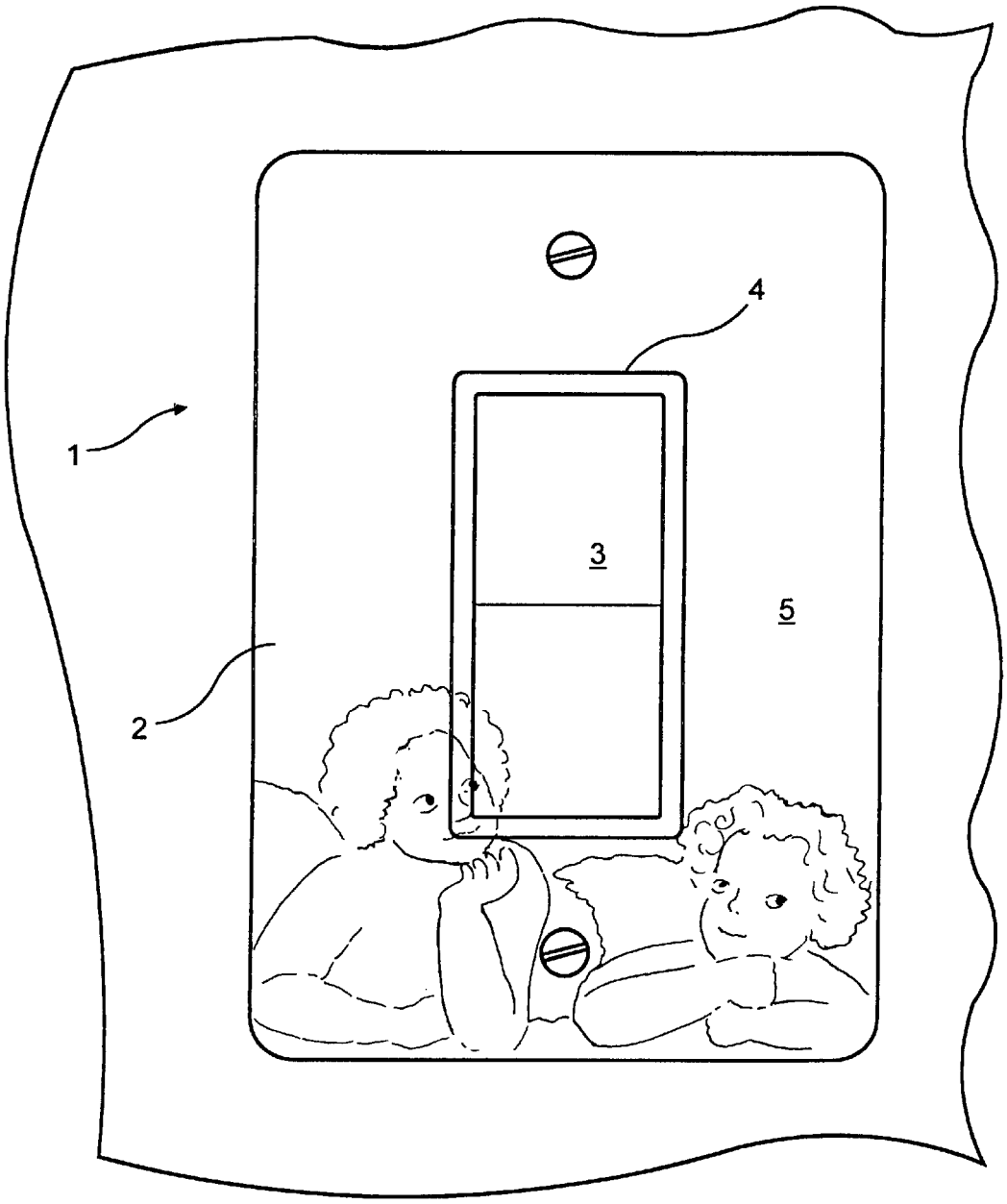
FIG. 1 is a view of a wall plate and an electrical switch having a unitary image.

Referring to FIG. 1, an assembly 1 comprises a wall plate 2 and an electrical component 3. The wall plate 2 has an opening 4 for receiving the electrical component 3. A unitary image, indicated as numeral 5, is provided on the wall plate and the electrical component, substantially improving the appearance and aesthetics of the assembly.

Wall plates are well known in the art for covering a component container such as a wiring box where connections are made to the electrical component. Of course, multiple gang boxes are known and used and these wall plates typically have a standard width but differ in length to cover such gang boxes. While commonly having straight sides, shaped wall plates are also well known and adaptable to use with the invention. For ease in illustration, a single electrical component mounted in a single wall plate will be discussed below, though the invention is not so limited.

"Electrical Component" means any item mounted with a wall plate such as, but not limited to, toggle switches, rocker switches, slide switches, single or duplex electrical outlets, and combination switch outlets. Because of their functionality, these items have complex geometry surfaces, such as those defined by the movable switch element, or by the prong receptacle passages in an outlet. Failure to image these portions would cause a discontinuity that would detract from the overall image presentation.

Figure 2:
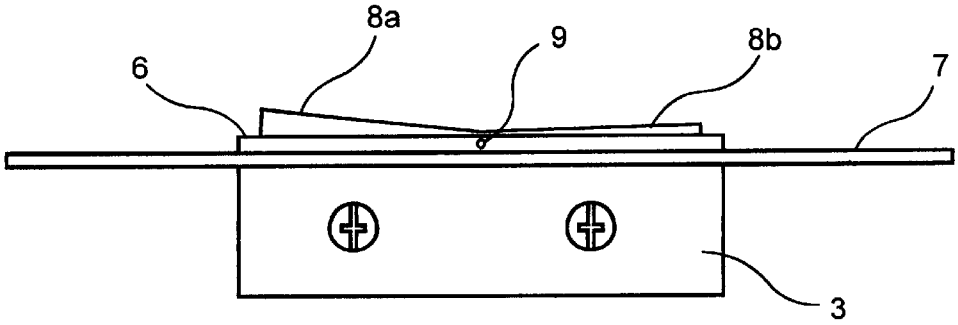
FIG. 2 is a view taken along line 2—2 of FIG. 1.

Referring to FIG. 2, a cross-sectional view is shown of the plate and electrical component as an assembly. The electrical component 3 does not typically mount entirely flush to the wall plate, providing a first elevated surface 6, relative to a wall plate upper surface 7. The component is a rocker switch that has a pair of wings 8*a* and 8*b* angled relative to each other, the wings movable about a pivot axis 9. Depending on which wing is depressed, the switch is either on or off. Thus, one wing is always elevated, complicating the imaging process.

Despite the presence of these stepped surfaces, a substantially continuous unitary image is presented. This is achieved by the methods described below.

Figure 3:
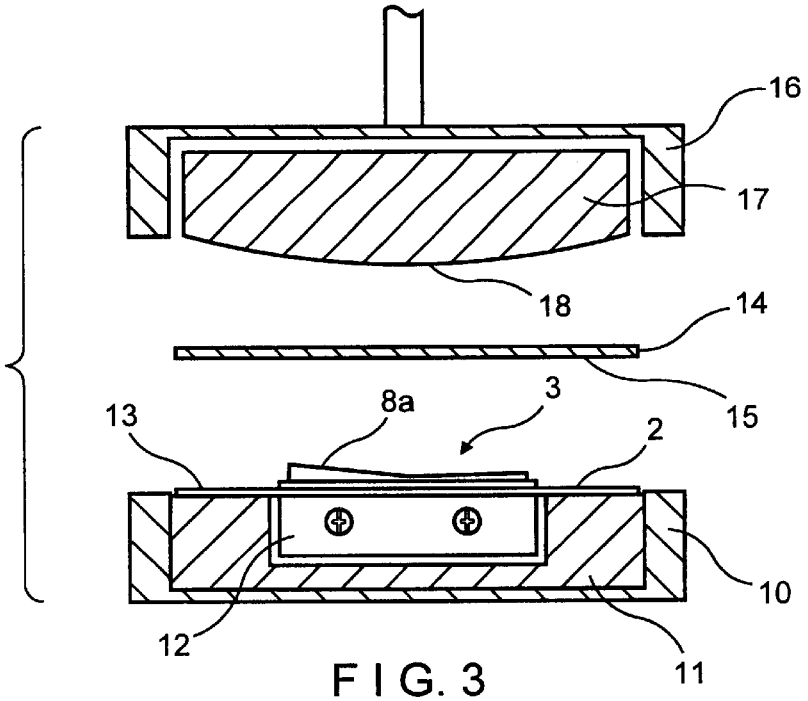
FIG. 3 is an exploded view of the system used to transfer an image to the electrical switch and wall plate as an assembly.

Referring to FIG. 3, an exploded view of a system for simultaneous transfer printing is shown.

Prior to transfer printing the wall plate and rocker switches are coated with a polymer coating that is typically a clear polyester, as is commonly known in the art.

A bottom base plate 10 has a counter sunk receptacle 11 for receiving the rocker switch body 12. The receptacle has a depth which provides for only the upper surfaces of the rocker switch to sit above the a plane of the base plate. Although the rocker switch encompasses the same area as the outlet receptacle and utilizes the same wall plate cover in its finished appearance, it's surface is not flat but sits at an approximate angle of 5–7°. The difference in elevation from one end of the switch to the other is approximately 0.125". When the switch is in a balanced position it rises 0.06" on each side from its fully depressed position.

Attention must be given to the angle and surface deviation when imaging so as to accommodate for these irregular surfaces. Once the rocker switch is placed in the base, the wall plate cover is placed over it. In this position, a face surface 13 of the wall plate and rocker switch assembly are generally along the same plane except for the wing 8*a* which angles upwardly. A dye sublimation transfer sheet 14 containing a unitary image 15 is placed face down on the wall plate and rocker switch assembly.

Figure 4:
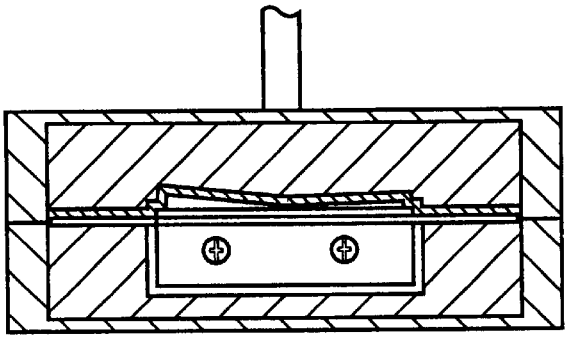
FIG. 4 is a cross-sectional view of the electrical component during transfer.

A heater block 16 contains a collapsible thermally conductive pressing means 17 which is brought into contact with the transfer sheet and wall plate/rocker switch assembly. To insure intimate contact along the full surface of the wall plate and the angled rocker switch, an additional raised area 18 of the collapsible pressing means is located adjacent a center area of the switch. The collapsible thermally conductive pressing means will then have a point of first contact with the transfer sheet, in the vicinity of the raised area, with contact then extending radially therefrom until full contact is achieved. The pressing means will collapse to varying degrees, depending on the surface contour, but the resilience of the collapsible pressing means assures that even pressure is applied over the entire surface. Thus, the collapsible pressing means will conform to the full surface of the wall plate and the irregular surfaces of the rocker switch as shown in FIG. 4. The heat press is activated to apply pressure at about 15–20 psi with heating at about 410° F. for approximately 60–90 seconds to transfer the image creating a continuous image on the surface of both items.

Alternatively, the imaging process can be separated such that the wall plate and electrical component can be separately printed. This is of particular use where different modular electrical components can be interchanged in a wall plate having a common opening size, the modular components having a common outer diameter. A single wall plate can thus mount a selection of electrical components.

Figures 5A, 5B, 5C:
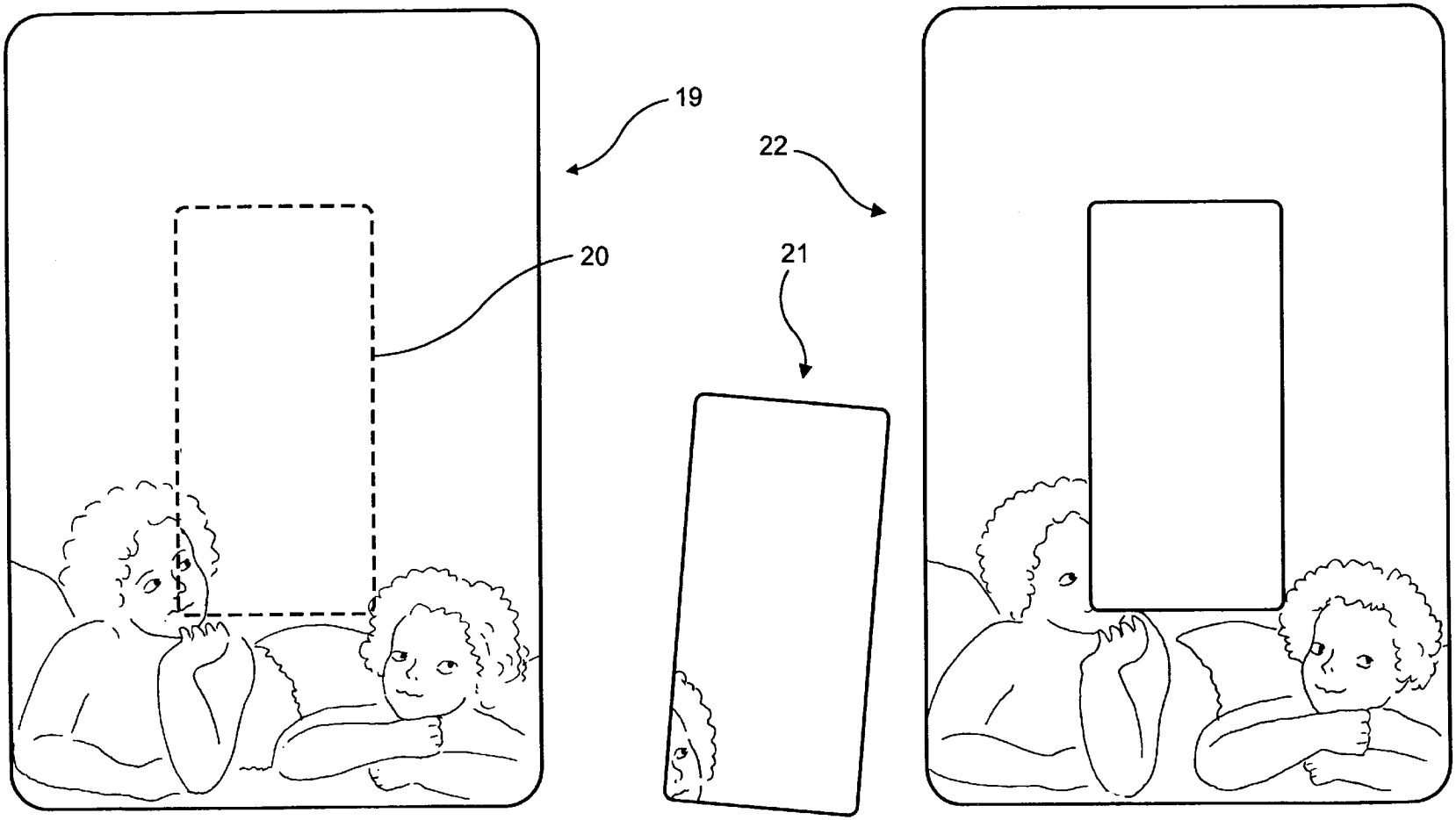
FIG. 5*a* is a view of the unitary image, illustrating the selected portion.
FIGS. 5*b* and 5*c* show the separated image portions.

Referring to FIG. 5*a*, a unitary image 19 is shown. The image is preferably in digital form for ease in manipulation. The image is first sized to fit a standard single component wall plate. This can be done either by cropping the image or by altering the borders by dragging the side boundaries of the image. The choice of technique is left to the user, as such sizing techniques are known.

Once sized, an outline 20 corresponding to the opening in the wall plate is selected on the image. This is indicated by the dotted line. The selected portion is then cut or copied from the image and saved as a second digital image file, creating a first image portion 21 and a second image portion 22, as shown in FIGS. 5*b* and 5*c*.

The first and second image portions are then used to produce two separate image transfer sheets made using sublimation dyes. Of course, multiple sheets can be made of each image portion, and the invention is not limited to a one to one correspondence. Preferably, multiple wall plates and multiple electrical components are printed in bulk to reduce costs by printing components in bulk.

Figure 6A:
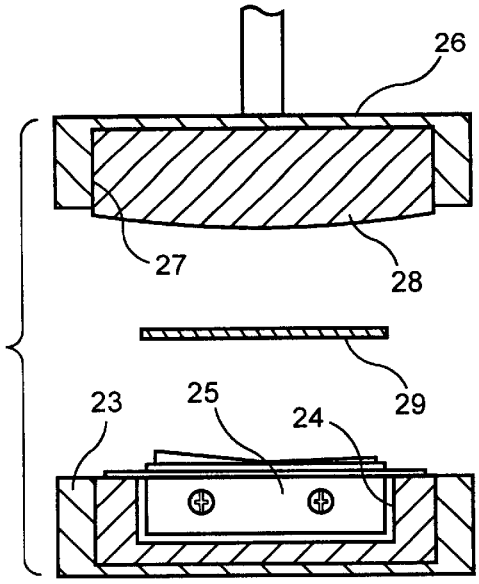
FIG. 6*a* an exploded view of the system used to transfer an image to a wall plate, and to a separate electrical component.
Figure 6C:
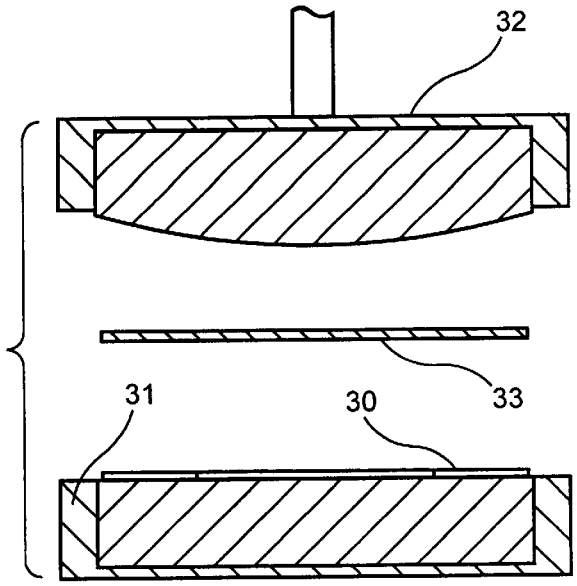
FIG. 6*b* shows a top view of a multi-component holding tool for multiple image transfer.
Figure 6B:
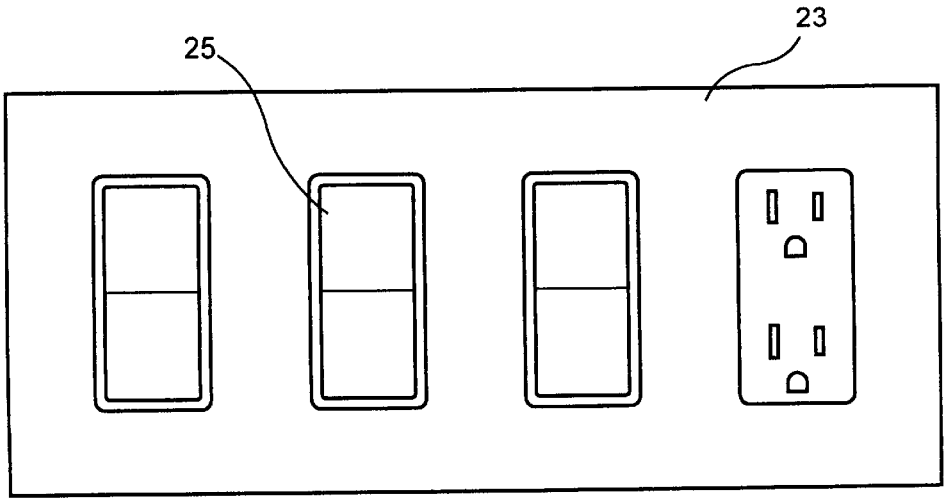

FIG. 6*a* shows an arrangement that is used to print multiple electrical components. A holding tool 23 has multiple receptacles 24 for receiving electrical components 25. A heating tool 26 has multiple chamber 27 for receiving multiple thermally conductive compressible sponges 28, corresponding in number and position to the locations of the receptacles 24. A single transfer sheet 29 extends for the length of the tool and has multiple images corresponding in number also to the number of receptacles such that all the electrical components can be printed at the same time. FIG. 6*b* shows a top view of the tool 23 holding four electrical components for printing. Of course, the tool can be sized to accommodate virtually any number of electrical components.

Referring to FIG. 6*b*, a system for printing a wall plate 30 separate from the electrical component is shown. As the wall plate is substantially flat, the tooling is simplified comprises a bottom plate 31 for receiving the wall plate and a heater block 32, having a shape corresponding to the wall plate, the wall plate receives a transfer sheet 33 which is pressed onto the wall plate with heat and pressure to effect transfer of the second image portion to the wall plate. Of course this could also be a multi-receptacle tool, as described above.

The electrical component, requires a bottom plate having a receptacle for receiving the component body, allowing only the surface of the component to sit above a plane of the bottom plate. The transfer sheet with the first image portion is placed on the component and a heater block having a collapsible thermal conductive pressing means is then brought into contact with the transfer sheet to apply heat and pressure. The collapsible thermal conductive pressing means contours the transfer sheet to the complex surface geometries, assuring a continuous image over these surfaces.

After the transfer is complete, the heater block is removed, the transfer sheet peeled off and the electrical component is ready for packaging with the wall plate. Preferably, the component and the wall plate are packaged as a kit with the necessary fasteners for mounting included, so one can install the complete assembly.

The collapsible thermal conductive pressing means may be a sponge or foam that is sufficiently collapsible to adapt to the complex surfaces of the electrical component, without bridging over low areas, that is, the pressing means must fill depressions to obtain a continuous image, yet the sponge must not be so collapsible as to prevent sufficient pressure from being exerted in these areas to assure proper image quality. Generally, a silicone sponge rubber having a density of from about 0.015 to 0.045 lbs/in$^3$ and a compressive deflection of 5–25 psi when compressed 25% at room temperature may be used. Of course, other collapsible means, such as an air or liquid filled bladder could also be used.

By utilizing a thicker portion of sponge in a center area which first contacts and holds the transfer sheet, contact extends radically thereafter to achieve full contact with the surface before pressure increases with the further collapse of the sponge as the tool continues to move into proximity with the electrical component. This in essence gradually spreads the transfer sheet to assure filling of depressions and coverage of high, curved or other contours on the surface.

Figure 7B:
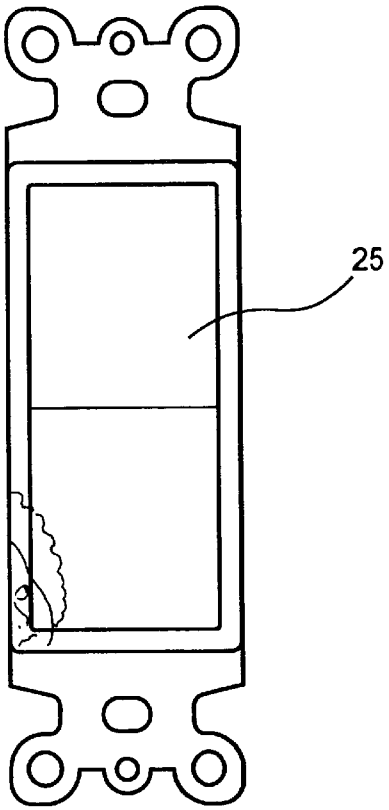
FIG. 7*b* shows the switch that can replace the outlet.
Figure 7A:
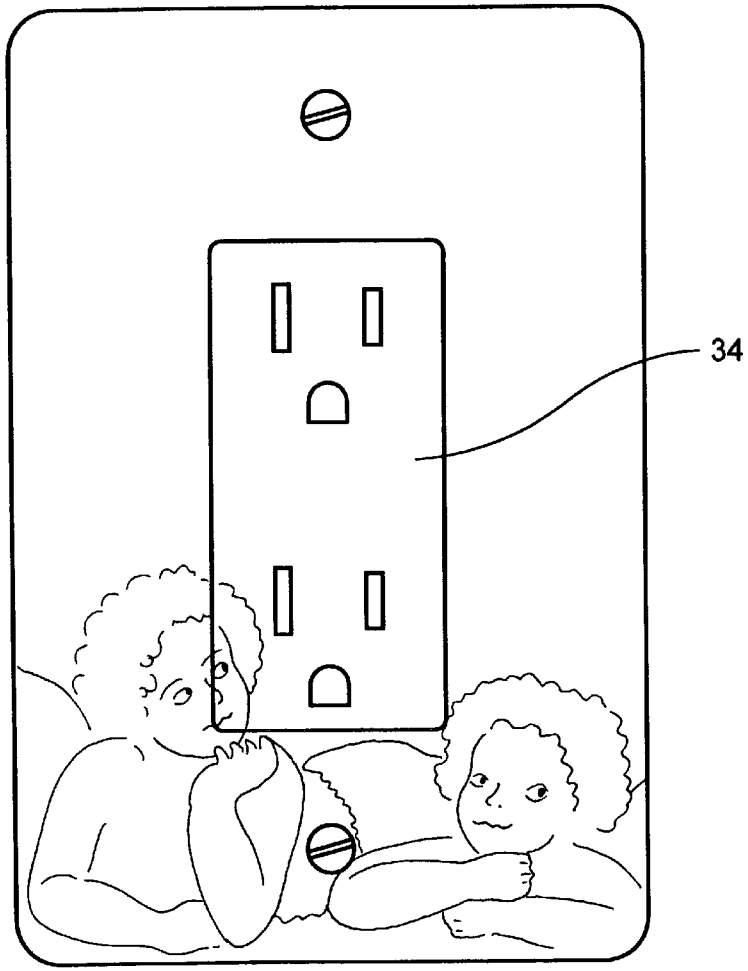
FIG. 7*a* is a front view of a wall plate and electrical outlet containing a unitary image in accordance with the present invention.

Referring to FIG. 7*a*, an electrical outlet 34 that is a modular substitute for the rocker switch described previously is shown, FIG. 7*b* showing the rocker switch. The same methodology is used as follows:

A bottom base has a counter sunk receptacle for receiving the outlet receptacle, allowing only the face surface of the outlet receptacle to sit above the plane of the base. The wall plate is placed over the receptacle outlet so that the center surface of the wall plate and the surface on the outlet receptacle are generally on the same plane. A dye sublimation transfer sheet is placed face down on top of the wall plate/outlet receptacle assembly. The heater block has mounted therein the collapsible thermal conductive sponge which assures intimate contact, equal pressure, and balanced distribution of heat upon the wall plate and its inserted receptacle outlet. The heat press is activated so as to apply pressure at about 15–20 psi with heating at about 410° F. for approximately 60–90 seconds to transfer the image to the coated wall plate/receptacle outlet assembly. Upon removal of the heater block and the transfer sheet, the image has transferred (sublimated) from the paper to the surface of the wall plate/receptacle outlet assembly. The result is a substantially continuous image along the surface of the wall plate and the surface of the receptacle outlet, including extension into the prong receiving passages.

Figure 8:
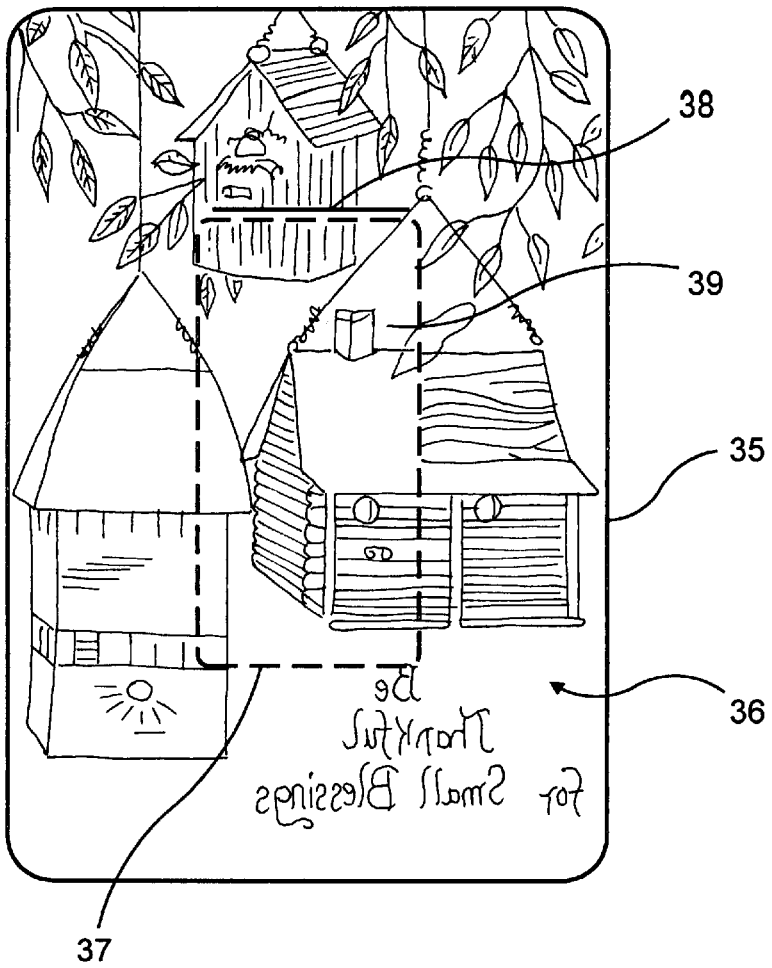
FIG. 8 is a view of an image transfer sheet.

Many electrical components have sharply defined features such as the elevated edge of the rocker switch platform. For these, additional steps can be taken to assure uniform low distortion image transfer. Referring to FIG. 8, a transfer sheet 35 has an image 36 thereon. An outline of a rocker switch toggle platform is shown by a phantom line 37. An incision 38 is provided in the transfer sheet along a part of the outline, adjacent an end 39 of the rocker switch platform which is elevated, forming a ledge. As the transfer sheet is generally not resilient, the incision provides a relief area which allows the transfer sheet to more readily conform to the surface without distortion, avoiding bridging over steeply defined areas. The thermally conductive pressing means is thus not restricted by the transfer sheet and readily adapts the transfer sheet to these types of contours. The locations for such incisions can be selected and marked during cutting and or cropping of the digital image.

Figure 9:
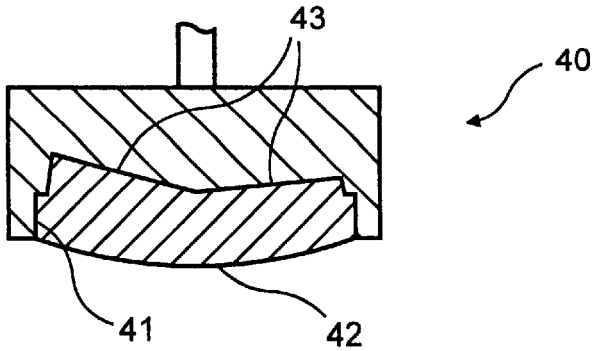
FIG. 9 is a cross sectional view of a heating tool having a shaped receptacle.

In another embodiment of the invention, shown in FIG. 9, a tool 40 has a shaped receptacle 41 for receiving a compressible medium 42. The shape of the recepticle substantially matches the surface which will receive the image. In this instance, sloped surfaces 43 match the rocker switch platform surface, so that as the tool presses onto the surface, the degree of compression of the pressing means is fairly uniform across the entire surface. This assures that high areas are not subject to high pressures and that low areas are not subject to too low pressure during transfer, promoting even pressure across all the contoured surfaces.

Utilizing the applicants invention, a unique article is created, a combination of a wall plate and electrical component which have matching image portions to provide a unitary image when assembled and mounted on a wall. These components can be sold as a kit for later assembly. This is a significant advance in the art, removing a discontinuity that detrimentally affected the overall aesthetic appearance obtained where the wall plate alone had the decorative image.

In addition, a process is used which is adaptable to imaging articles that have complex geometry surfaces, that is surfaces that have flat, curved, high, and/or low portions, and combinations thereof, as well as of various shapes. Such articles were not considered suitable for transfer printing but such is achieved utilizing the present invention.

While preferred embodiments of the invention have been shown and described, it will be understood by these skilled in the art that various changes or modifications can be made without varying from the scope of the invention.

What is claimed is:

1. A method for providing an image on a wall plate and an electrical component comprising:

providing an electrical component having a front contoured surface containing an image receiving coating;

providing a wall plate having an opening for receiving the electrical component therein and a front surface adjacent thereto, the front surface having an image receiving coating thereon;

placing the wall plate over the electrical component;

placing the wall plate and electrical component in a holding tool;

providing an image on a transfer sheet having a size sufficient to cover the wall plate and the electrical component;

placing the transfer sheet on the front contoured surface of the electrical component and the front surface of the wall plate;

providing a heating tool containing a collapsible thermally conductive pressing means having a corresponding size for transferring the image to both the wall plate and the electrical component; and moving the heating tool towards the wall plate and electrical component, contacting the transfer sheet and pressing the transfer sheet against the front contoured surface using the collapsible thermally conductive pressing means to conform the transfer sheet to the front contoured surface, the heating tool moved until a selected pressure and heat are applied to the transfer sheet; and transferring the image to the front contoured surface of the electrical component and the front surface of the wall plate.

2. The method of claim 1 wherein the collapsible thermally conductive pressing means has a raised area, and further comprising first compacting the transfer sheet adjacent the raised area.

3. The method of claim 1 wherein the collapsible thermally conductive pressing means is selected from the group consisting of a foam pad, a sponge, or a fluid filled bladder.

4. The method of claim 1 further comprising providing at least one incision in the transfer sheet adjacent a high surface portion of the electrical component front contoured surface.

5. The method of claim 1 further comprising providing a heating tool having a receptacle for containing the thermally conductive pressing means therein.

6. The method of claim 5 wherein the receptacle has a shape substantially matching the front contoured surface.

7. A method for providing an image on a wall plate and an electrical component comprising:

providing an electrical component having a front contoured surface containing an image receiving coating;

providing a wall plate having an opening for receiving the electrical component therein and a front surface adjacent thereto, the front surface having an image receiving coating thereon;

providing an image and selecting a first portion of the image for transfer to the electrical component and a second portion for transfer to the wall plate, preparing first and second transfer sheets respectively therefrom, the first transfer sheet for transferring the first portion of the image to the electrical component, the second transfer sheet for transferring the second portion of the image to the wall plate;

placing the electrical component in a holding tool;

placing the first transfer sheet on the front contoured surface of the electrical component;

providing a heating tool containing a collapsible thermally conductive pressing means; and moving the heating tool towards the electrical component, contacting the first transfer sheet and pressing the transfer sheet against the front contoured surface using the collapsible thermally conductive pressing means to conform the first transfer sheet to the front contoured surface, the heating tool moved until a selected pressure and heat are applied to the first transfer sheet;

transferring the first image portion to the front contoured surface of the electrical component;

placing the wall plate in a holding tool;

moving the heating tool towards the wall plate, contacting the second transfer sheet and pressing the second transfer sheet against the front surface using the collapsible thermally conductive pressing means to conform the transfer sheet to the front surface, the heating tool moved until a selected pressure and heat are applied to the transfer sheet; and, transferring the second image portion to the front surface of the wall plate, such that when the wall plate and electrical component are combined, a substantially unitary image is obtained.

8. The method of claim 7 wherein the collapsible thermally conductive pressing means for the heating tool has a raised area, and further comprising first compacting the first transfer sheet adjacent the raised area.

9. The method of claim 7 wherein the collapsible thermally conductive pressing means is selected from the group consisting of a foam pad, a sponge, or a fluid filled bladder.

10. The method of claim 7 further comprising providing at least one incision in the first transfer sheet adjacent a high surface portion of the electrical component front contoured surface.

11. The method of claim 7 further comprising providing a heating tool having a receptacle for containing the thermally conductive pressing means therein.

12. The method of claim 11 wherein the receptacle has a shape substantially matching the front contoured surface of the electrical component.

* * * * *